US005341993A

United States Patent [19]

Haber et al.

[11] Patent Number: 5,341,993

[45] Date of Patent: Aug. 30, 1994

[54] TOPICAL SPRAYER WITH REMOTELY ACTUATED SPRAY TIP

[75] Inventors: Terry M. Haber, Lake Forest; William H. Smedley, Lake Elsinore; Clark B. Foster, Laguna Niguel, all of Calif.

[73] Assignee: Habley Hills Technology Corporation, Laguna Hills, Calif.

[21] Appl. No.: 995,556

[22] Filed: Dec. 21, 1992

Related U.S. Application Data

[63] Continuation of Ser. No. 747,299, Aug. 19, 1991, abandoned.

[51] Int. Cl.[5] ..... B05B 9/047

[52] U.S. Cl. ..... 239/331; 239/492; 222/321; 222/385

[58] Field of Search ..... 239/327, 333, 331, 490, 239/491; 222/321, 325, 372, 383, 385, 386; 128/200.23, 200.14

[56] References Cited

U.S. PATENT DOCUMENTS

| | | | |
|---|---|---|---|
| 912,691 | 2/1909 | Koenigkramer | 239/396 |
| 1,961,371 | 6/1934 | Mapes | 22/325 X |
| 2,774,517 | 12/1956 | Teegardin et al. | 22/385 X |
| 2,888,173 | 5/1959 | Wolcott | 222/325 X |
| 3,184,123 | 5/1965 | Willshaw | 222/383 X |
| 3,348,546 | 10/1967 | Roberts et al. | 222/385 X |
| 3,386,664 | 6/1968 | Knibb | 239/327 X |
| 3,406,909 | 10/1968 | Pfeiffer | 239/333 |
| 3,429,310 | 2/1969 | Jaffe et al. | 222/325 X |
| 3,534,890 | 10/1970 | Iannacone | 222/325 X |
| 3,604,417 | 9/1971 | Stolzenberg | 222/389 X |
| 3,768,705 | 10/1973 | Spatz | 222/386 X |
| 3,961,756 | 6/1976 | Martini | 239/337 |
| 3,979,027 | 9/1976 | Loeffler | 222/383 X |
| 4,102,476 | 7/1978 | Loeffler | 239/327 X |
| 4,109,869 | 8/1978 | Brockelsby et al. | 239/491 |
| 4,236,651 | 12/1980 | Meyer et al. | 222/383 X |
| 4,944,424 | 7/1990 | Bishop et al. | 222/321 X |

FOREIGN PATENT DOCUMENTS

| | | | |
|---|---|---|---|
| 2645835 | 10/1990 | France | 239/333 |

*Primary Examiner*—Andres Kashnikow
*Assistant Examiner*—Kevin P. Weldon
*Attorney, Agent, or Firm*—Tonwsend & Townsend Khourie & Crew

[57] ABSTRACT

A hand held sprayer mechanism with remotely actuated spray tip. The invention includes a sprayer sub-assembly coupled to a spray head adapter. The sprayer sub-assembly has a fluid chamber with an exit port and means for pressurizing the fluid contained within the chamber to thereby cause displacement of the fluid through the exit stem. The sprayer includes a valve which opens by forcing the exit stem towards the container. The spray head adapter is configured to remotely secure to the exit port and at least partially contain the sprayer sub-assembly. The spray head adapter includes a body, a spray tip and finger ledges extending out from the body and spaced apart from the spray tip a substantial distance. The user can remotely actuate the spray valve and release a spray stream by application of compressive force between the finger ledges and the proximal end of the sprayer sub-assembly extending out from the body of the spray head adapter. The remotely actuated spray tip allows for greater accessibility to ulcerated tissue cavities, reduced infection potential by placing operator's finger tip outside and away from the wound, enhanced precision directional control of atomized particles, spray expulsion in any direction and greatly enhanced shatter resistance of the device.

3 Claims, 8 Drawing Sheets

TOPICAL SPRAYER WITH REMOTELY ACTUATED SPRAY TIP

This is a continuation of application Ser. No. 07/747,299, filed Aug. 19, 1991, now abandoned.

BACKGROUND OF THE INVENTION

Many topical medications including antiseptics, analgesics, anesthetics and Platelet-Derived Growth Factor (PDGF) are applied to integument or skin to reduce tactile sensation, cause numbing or aid in the healing process. Likewise, anti-fungal medications must also be topically applied in most circumstances.

Various hand held applicators such as aerosol sprayers and squeeze bottles have been developed for topical application of liquid medical products. For many topical applications, it is desirous to atomize the liquid medication being applied. Atomization is the mechanical subdivision of liquid into drops. The atomized drops can have a wide range of sizes depending on the particular application. A spray is typically considered to be coarse drops having a size in the range of 100 to 1,000 microns in diameter. To mist a liquid is considered to be the atomization of liquid into fine drops sized in the range of 10 to 100 microns in diameter. For most topical medication applications, spraying is considered sufficient. However, it is highly desirable for the user applying the medication to have an atomization device, or sprayer, which provides good directional control of the spray and allows the medication to be applied from a distance that will not jeopardize further traumatization of the skin by inadvertent touching by the user's hand or by the sprayer itself.

Some topical pharmaceuticals and medications come commercially prepackaged in medication vials, similar in appearance to cartridges used for syringe applications, but modified as a sprayer sub-assembly. The sprayer sub-assembly includes an index finger actuated spray pump with a spray head which directs the spray from the pump at a 90° axis from the longitudinal axis of the vial. One such product is marketed by Amgen Corp. of Thousand Oaks, Calif. and available from Tower (Medical) American Convertors division of American Hospital Supply Corporation under part no. 92308 ($3\frac{1}{2}'' \times 8''$) 8T89E (hereinafter "PDGF Airless Topical Applicator"). These spray sub-assemblies require the user to grasp the sprayer between the thumb and fingers and use the index finger to actuate the sprayer head in a pumping motion and discharge the medication from the sprayer to the desired surface. The actuation of the sprayer sub-assembly is similar to that used for commercially available hand held aerosol breath sprays.

There are several disadvantages with this sprayer structure. Because the spray head is used to actuate the spray pumping mechanism, the spray head must be moved, or pumped, relative to the liquid container or vial to actuate the spray mechanism. Furthermore, the head is pumped by the index finger and the spray exits from the spray head at a 90° angle relative to the axis of the pumping motion and at a point immediately adjacent the user's index finger, the directional control of the spray is compromised. Unless the user compensates for the pumping motion by moving the entire spray assembly during spraying, each pump or stroke of the spray head causes the point of origin of the spray to change in location. This motion compromises the directional stability of the spray stream.

Additionally, the index finger actuated pumping structure requires the user to grasp the spray assembly in such a way that the longitudinal axis of the spray assembly must be positioned generally parallel to the surface of the skin receiving the spray. This positioning is a product of the spray exit stream being directed at a 90° angle relative to the pumping axis of the sprayer. In some circumstances, the user may have to position the sprayer close to the skin to aim the spray in a particular area. This awkward positioning may cause inadvertent contact between the traumatized skin receiving the spray and the user's hand or the sprayer itself. Where sterility is concerned, this potential for contact has profound ramifications.

Accurate aiming of an index finger controlled sprayer can also be a problem. Once the user grasps the sprayer, the nozzle on the spray head faces away from the user. Due to the shape of a typical index finger actuated spray head, the user cannot be sure of the aim until spraying has begun. The first pump of the sprayer sometimes directs the spray in an undesired direction. Furthermore, users with large index fingers or improperly positioned index fingers may also deflect part of the exiting spray with the index finger protruding in front of the spray nozzle. This may also compromise aiming and sterility. Therefore, there is a need for an improved hand held topical sprayer which eliminates these and other disadvantages of prior art devices.

SUMMARY OF THE INVENTION

The present invention is directed broadly to a topical sprayer for application of atomized liquids. More specifically, the invention relates to a hand held sprayer having a remotely actuated spray tip.

In the preferred embodiment, the invention includes a topical sprayer sub-assembly having a fluid container with an exit stem and a means for pressurizing the fluid contained within the container to provide displacement of the fluid or medication through the exit stem. The invention includes a spray head adapter configured to secure onto the exit stem and configured to provide remotely actuated pumping of the sprayer sub-assembly.

The topical sprayer sub-assembly in the preferred embodiment is configured similar to that commercially available as the previously referenced PDGF Airless Topical Applicator having an exit stem extending outwardly from, and facilitating actuation of, the spray pump mechanism. The spray head adapter couples with the exit stem and includes a body portion with a spray tip disposed at its distal end and a finger ledge spaced apart a substantial distance from the spray tip and extending outwardly from the body portion. The spray head adapter is used to remotely trigger or pump the exit stem of the sprayer sub-assembly and provides enhanced shatter resistance for the device.

The body portion of the spray head adapter includes a cavity to receive the sprayer sub-assembly along its longitudinal axis. The spray head adapter slips over and couples with the exit stem of the sprayer sub-assembly near the distal end of the body to provide a fluid channel to a spray tip. When the sprayer sub-assembly is properly inserted into the spray head adapter, the user can actuate the pumping mechanism of the sprayer by applying a compressive force between the finger ledge and the outer surface of the sprayer sub-assembly. The action used to provide the compressive force is similar to that used to activate a typical syringe structure.

The invention allows the user to more directly control the spray stream and allows the spray pump mechanism to be remotely actuated away from the spray tip. This structure significantly decreases the potential for inadvertent user contact with the traumatized or ulcerated skin area by positioning the operator's fingers away from the skin area and increases directional control of the atomized particles. Additionally, unlike a conventional spray head directing the spray at a 90° angle from the axis of pumping movement, the user can get a clear visual indication as to the alignment of the spray stream before actuation of the sprayer. The spray stream is directed in a path parallel to the longitudinal axis of the entire sprayer and spray head adapter assembly.

In addition to the above, the preferred embodiment of the spray tip includes a swirl atomizer which breaks up the liquid medication being applied into spray droplets using a unique atomization channel. The swirl atomizer includes a fluid channel coupled with the exit stem of the sprayer sub-assembly and connects to a circular ring channel coupled to a plurality of tangentially converging spoke channels which connect to a centralized exit aperture. The multiple converging channels cause swirling of the multiple converging liquid streams conveyed through the spoke channels into the centralized aperture to atomize the liquid and break up the liquid into the desired spray or mist drops.

The invention provides a remotely actuated and highly directionally controllable sprayer for topical applications using a simple and low cost structure which is superior over prior art devices.

Other features and advantages of the invention will become apparent from the following description in which the preferred embodiments have been set forth in detail and in conjunction with the accompanying drawings.

DETAILED DESCRIPTION OF THE PREFERRED EMBODIMENT

Figure 1:
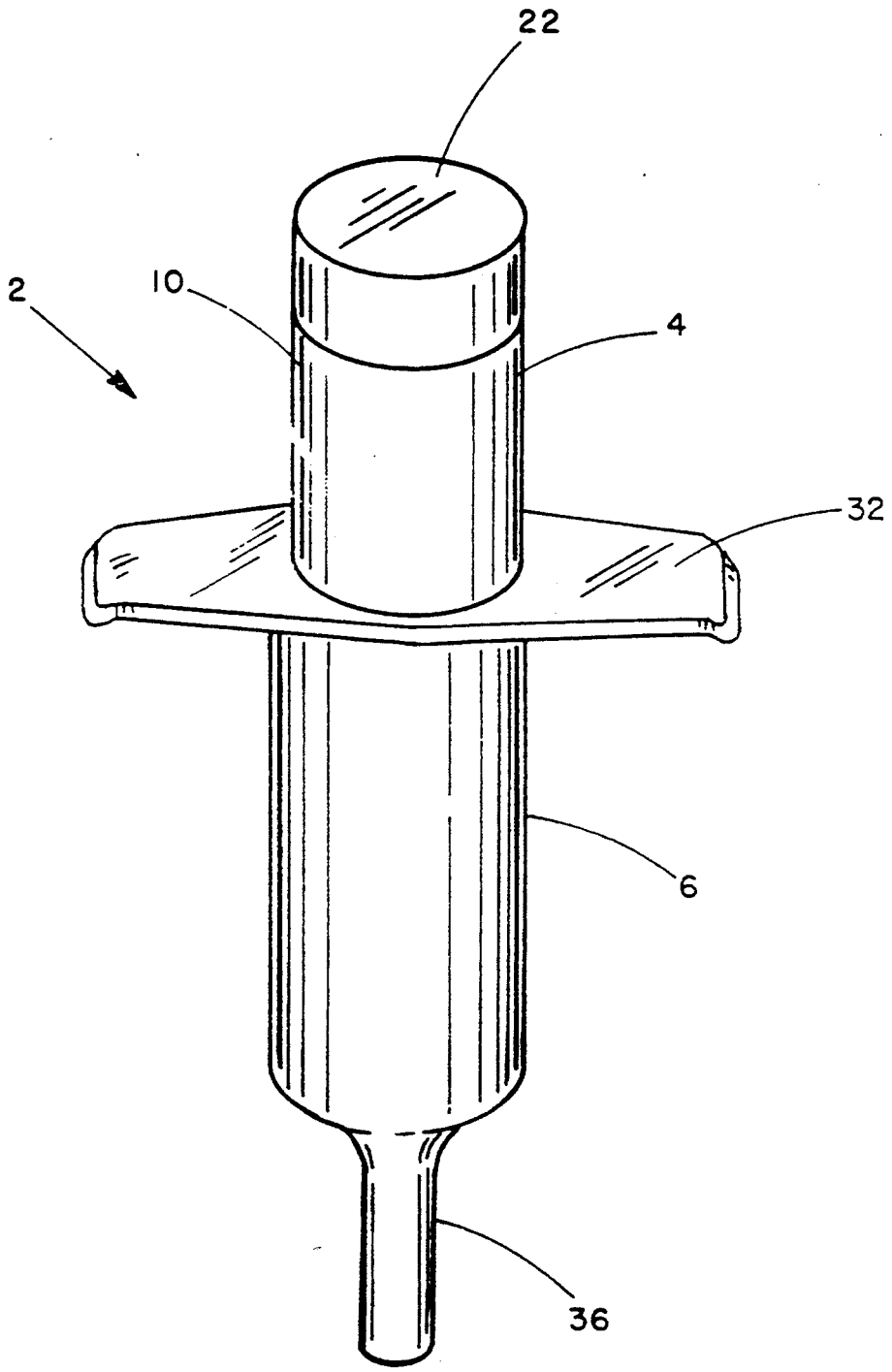
FIG. 1 is a perspective view of the preferred embodiment of the invention illustrating the sprayer sub-assembly fully engaged with the spray head adapter.

The preferred embodiment of topical sprayer 2 is shown in FIG. 1. Topical sprayer 2 includes sprayer sub-assembly 4 and spray head adapter 6. Sprayer sub-assembly 4 is shown in the fully engaged condition with spray head adapter 6 with sprayer sub-assembly 4 removably inserted into spray head adapter 6.

Figure 2:
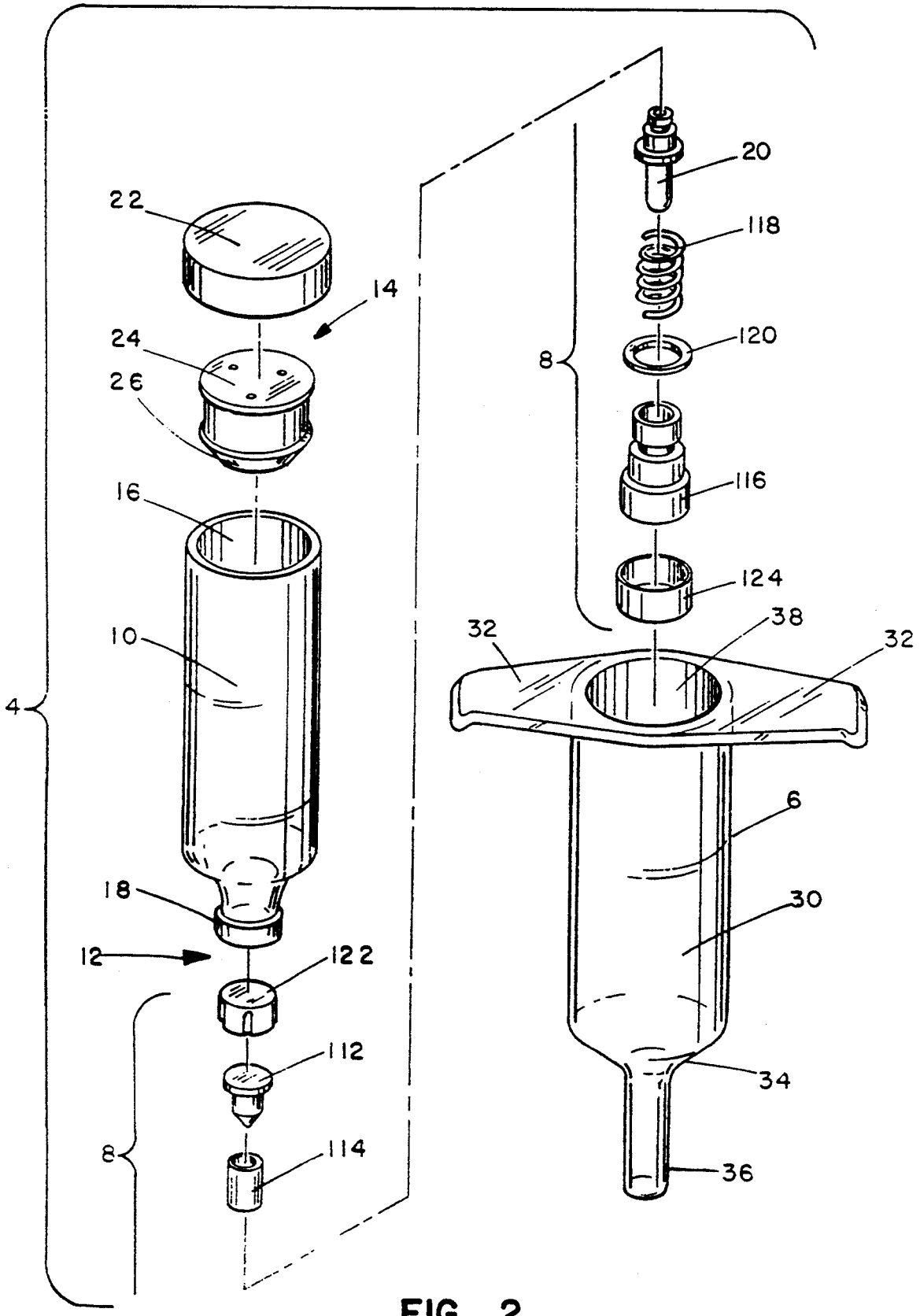
FIG. 2 is an exploded perspective view of the invention shown in FIG. 1 illustrating the components of the sprayer sub-assembly and the spray head adapter.

Referring now to FIG. 2, the invention illustrated in FIG. 1 is shown in exploded view with sprayer sub-assembly 4 removed from spray head adapter 6. In the preferred embodiment, sprayer sub-assembly 4 includes liquid container 10 having a distal end 12 and proximal end 14. Liquid container 10 is configured as vial 16 having an inside surface 28. Piston 24 is slidably secured within vial 16 and produces a fluid type seal between sealing ridge 26 and inside surface 28. Cap 22 is removably secured to proximal end 14 of vial 16. At distal end 12, pump chamber 18 houses pump assembly 8 (more fully described below) having exit stem 20. Sprayer sub-assembly 4 can be constructed having any conventional finger actuated pump mechanism such as the configuration of the PDGF Airless Topical Sprayer commercially available from Amgen Corp. or suitable alternatives well known in the art. In this embodiment, medication liquid (not shown) is contained within vial 16 disposed between piston 24 and pump chamber 18 which houses a pump assembly 8.

Pump assembly 8 is preferably configured having exit stem 20, a first one way valve 112 and a second one-way valve 114 all housed within valve/stem housing 116. Pump assembly 8 also includes spring 118 disposed between valve/stem housing 116 and exit stem 20, O-ring 120, retainer 122 and crown 124. Pump assembly 8 is shown in cross-section in the assembled condition in FIG. 3.

Figure 3:
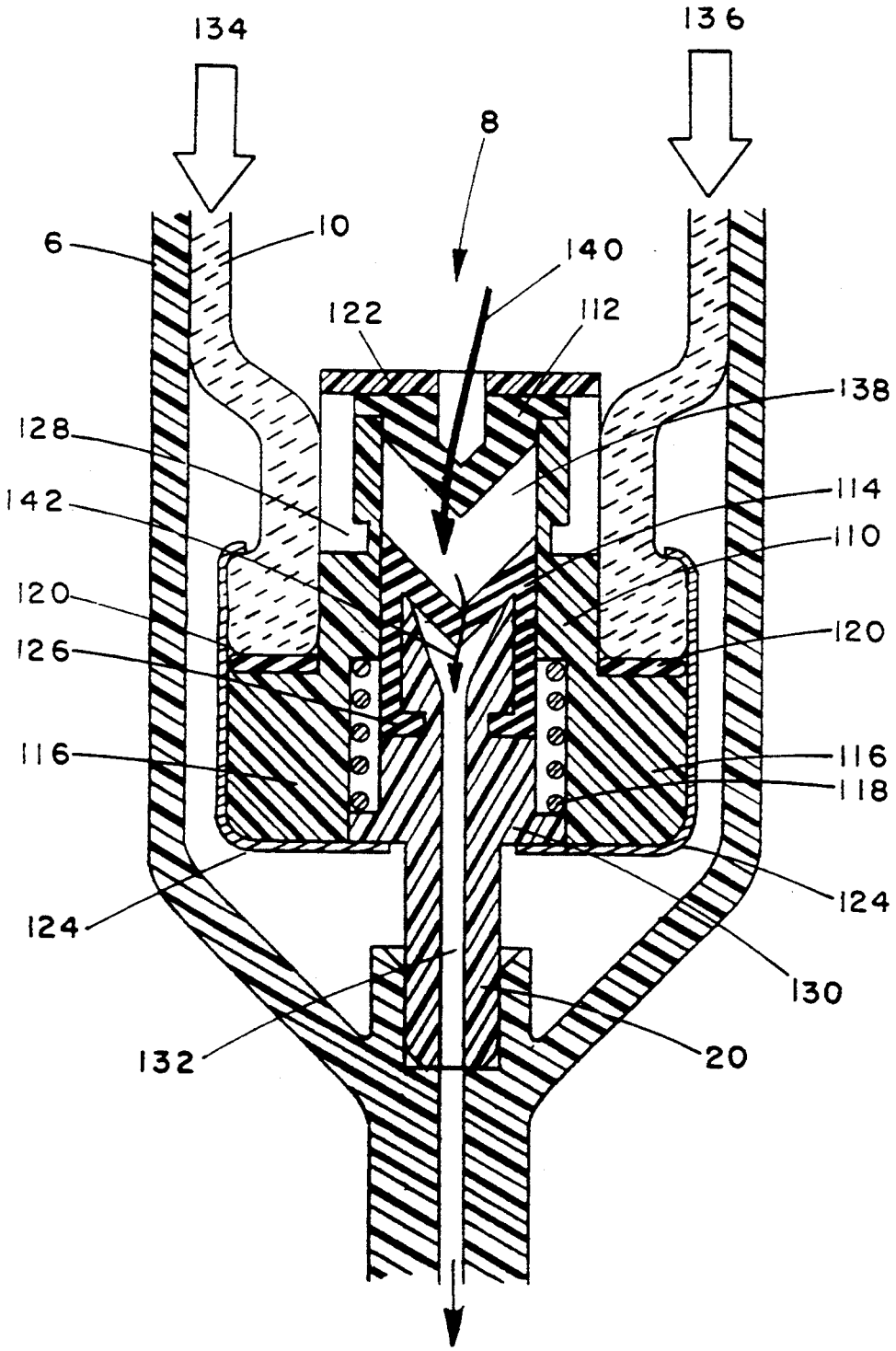
FIG. 3 is a partial side view in cross-section of the device in FIG. 2 in an assembled condition illustrating the component parts of the pump assembly.

Referring now to FIG. 3, pump assembly 8 is shown secured within pump chamber 18 located at the distal end of liquid container 10. Second one-way valve 114 secures to exit stem 20 by mating with recessed collar 126. First one-way valve 112 is retained against stem 20 by retainer 122, which secures to value/stem housing 116 about collar 128. Exit stem 20 is slidably mounted within valve/stem housing 116, and includes flange 130 and exit channel 132. Crown 124 secures valve/stem housing 116 to liquid container 10 with O-ring 120 disposed therebetween.

To activate pump assembly 8, force indicated by arrows 134, 136 is transmitted by compressive force asserted between spray head adapter 6 and sprayer sub-assembly 4. Spring 118, housed between flange 130 and stop 110, biases exit stem 20 away from first one-way valve 112 creating compressible chamber 138. Force 134, 136 causes valve/stem housing to compress spring 118 and drive second one-way valve 114 towards first one-way valve 112, thereby reducing the volume of chamber 138. As force 134, 136 is removed, the bias of spring 118 separates one-way valves 114, 112 increasing the volume of chamber 138. As the volume of chamber 138 increases, liquid contained in liquid container 10 is drawn through first one-way valve 12 as indicated by arrow 140 and fills chamber 138. Force 134, 136 is again applied and the liquid in chamber 138 is driven out second one-way valve 114, indicated by arrow 142, into channel 132 to atomizer 40. Repeated sequence of this action in a pumping fashion causes the liquid in liquid container 10 to exit through exit stem 20. One way valves 112, 114 prohibit liquid from traveling in the reverse direction.

Sprayer sub-assembly 4 is activated by forcing exit stem 20 towards proximal end 14 of vial 16 which actuates pump assembly 8 as previously described and displaces fluid contents of pump chamber 18 out through exit stem 20. Exit stem 20 is spring biased outwardly away from distal end 12 to thereby draw liquid from vial 16 using a vacuum into chamber 138 within pump assembly 8 thereby pulling piston 24 by suction to slide within vial 16 towards distal end 12 as liquid volume diminishes within vial 16. Alternatively, vial 16 may omit piston 24. However, piston 24 provides a structure which will not entrain air in the medical liquid before spraying. This may be desired in some applications.

Spray head adapter 6 includes body 30 having an outwardly extending finger ledge 32. Finger ledge can take many configurations and shapes, or a plurality of finger ledges can be used. Body 30 tapers to nose 34 and terminates at the distal end with spray tip 36. Body 30 includes cavity 38 located at its proximal end and configured to receive sprayer sub-assembly 4. Spray tip 36 houses swirl atomizer 40 and nozzle 42, the function of which will be more fully explained below.

Figure 4:
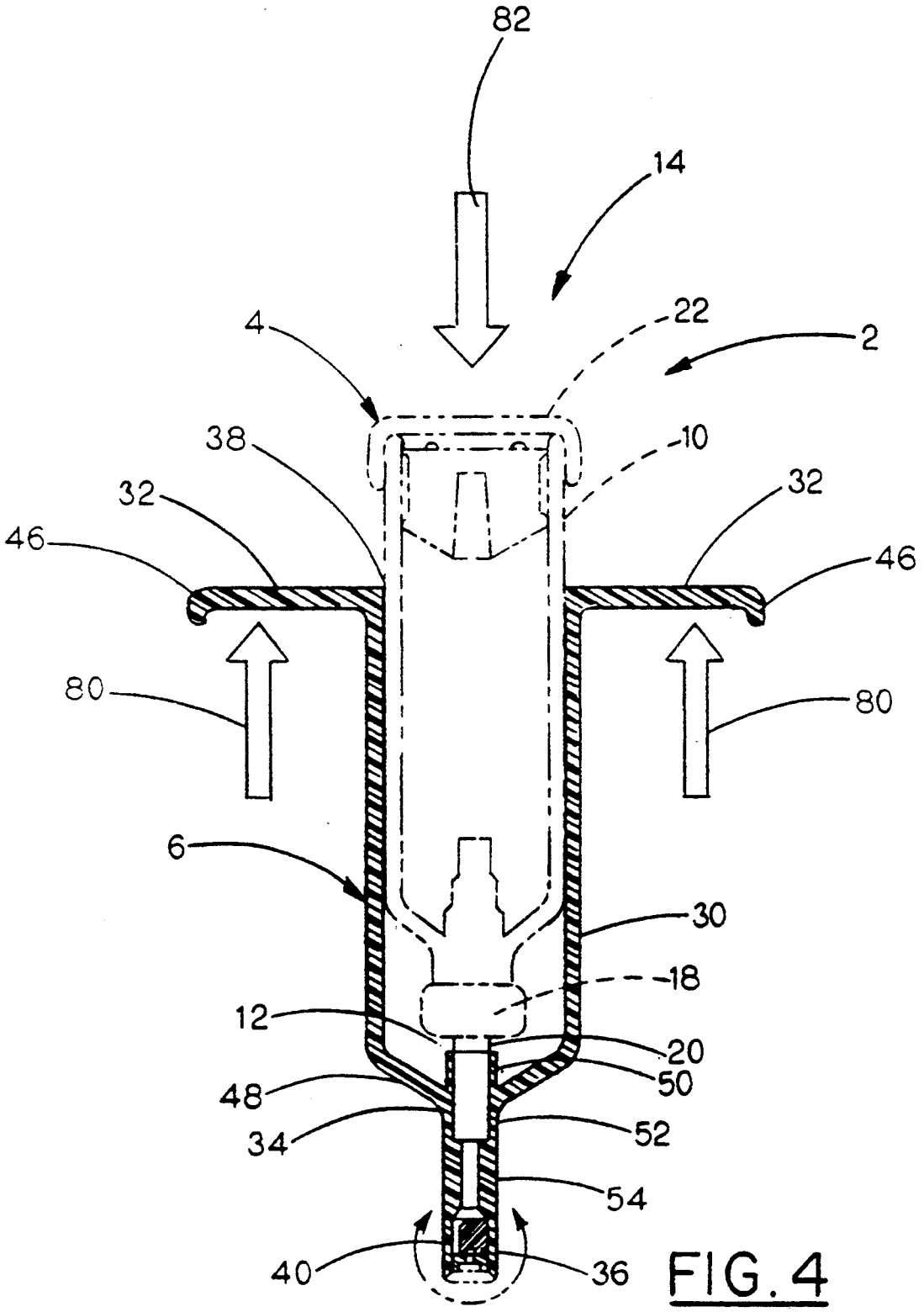
FIG. 4 is a cross-sectional side view of the spray head adapter of FIG. 2 with the sprayer sub-assembly shown disposed therein in phantom lines with the arrows indicating compressive force applied to actuate the spray tip.

Spray head adapter 6 is shown in FIG. 4 in cross-section with sprayer sub-assembly 4 indicated in broken lines. Sprayer sub-assembly 4 is illustrated inserted into cavity 38 with distal end 12 contacting spray head adapter 6. Sprayer sub-assembly 4 is made slidable within cavity 38, with cavity 38 having an inner diameter slightly greater than the outer diameter of liquid container 10. This allows spray head adapter 6 to be reusable. When fully inserted, exit stem 20 of sprayer sub-assembly 4 mates with stem housing 50 disposed within cavity 38. Exit stem 20 slidably couples with stem housing 50 and abuts stop 52. In this position, exit stem 20 is fluid coupled with spray channel 54 and spray tip 36 and sprayer sub-assembly 4 is in full longitudinal alignment with spray head adapter 6.

Spray head adapter 6 includes finger ledge 32 disposed a substantial distance from spray tip 36. Preferably, finger ledge 32 is disposed at the proximal end of spray head adapter 6. Alternatively, finger ledge 32 can be disposed anywhere along spray head adapter 6, but should be located a distance from spray tip 36 which is at least two times the diameter of body 30 to achieve the best safety and performance.

Spray head adapter 6 is preferably fabricated from a conventional transparent rigid plastics material suitable for medical devices. Likewise, liquid container 10 is also preferably transparent, fabricated from glass or clear plastic. This construction allows the user to view liquid volume within liquid container 10 during use where sprayer sub-assembly 4 is fully inserted into spray head adapter 6 as illustrated in FIG. 4. Additionally, when liquid container 10 is fabricated from glass or other brittle material and housed within spray head adapter 6, spray head adapter 6 provides protection against shattering if the device is dropped.

In the fully assembled condition, topical sprayer 2 is used to remotely activate spray tip 36 using a two-finger and thumb compressive force similar to that used with conventional syringe devices. Compressive force 80 is applied to finger ledge 32 using two fingers, and compressive force 82, applied by the user's thumb, is applied to proximal end 14 of sprayer subassembly 4 which extends out from cavity 38 of spray head adapter 6. In the embodiment shown in FIG. 4, compressive force 82 can be applied to cap 22. Compressive force 80, 82 causes sprayer sub-assembly 4 to slide within cavity 38 towards distal end 12 and force exit stem 20 into pump chamber 18 along the longitudinal axis of sprayer sub-assembly 4 towards proximal end 14. As previously described, it is this axial movement of exit stem 20 which activates the pumping mechanism of pump chamber 18 in a manner consistent with conventional index finger sprayers such as aerosol breath spray canisters or other conventional index finger activated mechanical pumping devices used in the preferred embodiment.

Therefore, the compressive force 80, 82 remotely activates spray tip 36 by displacing the liquid contents of liquid container 10 under pressure through pump chamber 18 and exit stem 20. The displaced liquid flows through spray channel 54 and into, and out of, spray tip 36 where the liquid is atomized by swirl atomizer 40 as will be described below. The magnitude and frequency of compressive force 80, 82 is controlled by the user as desired to regulate the amount of liquid spray or mist released from topical sprayer 2. Spray tip 36 should be positioned at least one centimeter away from the ulcerated tissue during spraying. Distances less than one centimeter can cause the liquid expelled from spray tip 36 to land as droplets on the ulcerated tissue because the liquid may have insufficient travel to nebulize. Also to increase directional control, finger ledges 32 can be made contoured or having perimeter ridge 46 to prevent the user's fingers from slipping off finger ledge 32 during activation.

Figure 5:
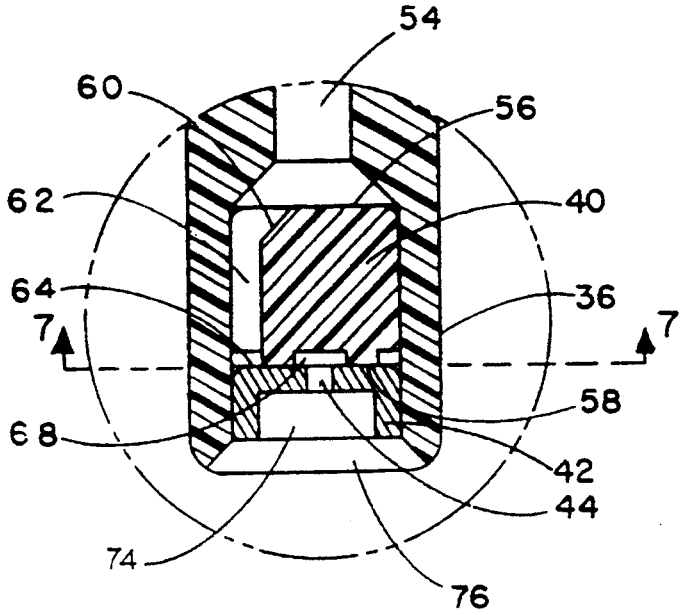
FIG. 5 is an expanded cross-sectional view of the spray tip shown in FIG. 4, illustrating detail of the swirl atomizer and nozzle.
Figure 6:
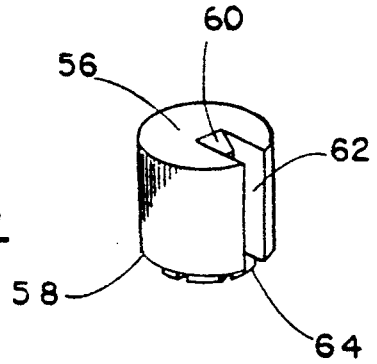
FIG. 6 is a perspective view of the swirl atomizer shown in FIG. 5.
Figure 7:
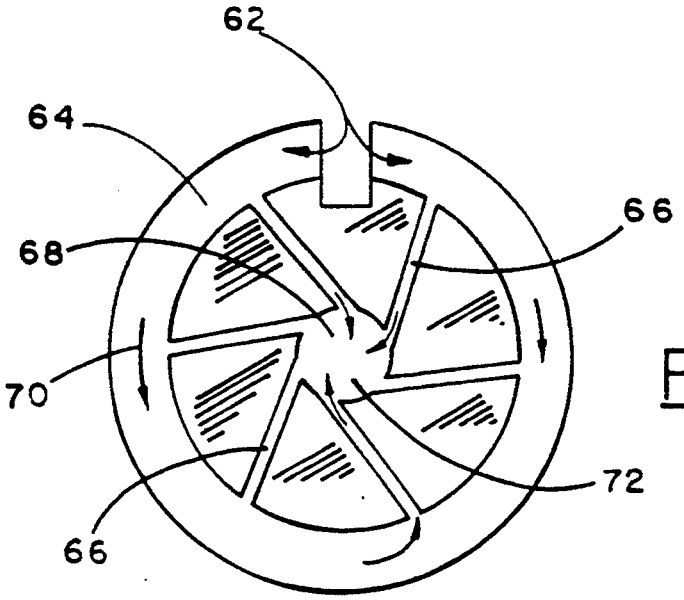
FIG. 7 is a front view of the swirl atomizer shown along section A—A indicated in FIG. 5.

Referring now to FIGS. 5–7 collectively, a more detailed discussion of the construction of the preferred embodiment of spray tip 36 is provided. FIG. 5 illustrates a cross-sectional view of spray tip 36 magnified from FIG. 4 where indicated by circular arrow. Spray tip 36 includes spray channel 54 which is fluid coupled to exit stem 20 as previously described. Spray channel 54 widens to house swirl atomizer 40 and nozzle 42 which are secured therein by appropriate press fitting or a suitable adhesive. Exiting liquid flows from the upstream end 56 to the downstream end 58 of swirl atomizer 40 and exits spray tip 36 through spray aperture 44 of nozzle 42. It is the structure of swirl atomizer 40 and the exiting through the structure which atomizers the liquid into the desired droplets to create a spray.

Referring now to FIGS. 5 through 7 together, the specific structure of the preferred embodiment of swirl atomizer 40 is described. Swirl atomizer 40 first channels the exiting liquid via a recessed slope 60 into side channel 62 where it passes upstream to downstream through side channel 62 and into ring channel 64. FIG. 7 illustrates the front side of swirl atomizer 40 indicated along section A—A of FIG. 5. As indicated, swirl atomizer 40 is disposed within spray tip 36 such that this front side is near the distal end of spray channel 54 and abuts nozzle 42.

Swirl atomizer 40 directs the liquid path down along side channel 62 and around ring channel 64 as indicated by arrows 70 in FIG. 7. The fluid pressure driving the travelling liquid through spray channel 54 causes the liquid to evenly disperse around ring channel 64. The liquid then divides up and passes through a plurality of spoke channels 66 which tangentially converge to central aperture 68. The configuration of spoke channels 66 cause the plurality of liquid jet streams to collide at angles relative to one another at high pressure and velocity and thereby atomize under turbulence within central aperture 68 and exit through spray aperture 44 of nozzle 42. The exiting stream of droplets pass through recess 74 causing a partial pressure loss about the perimeter of recess 74 which entrains air within the stream of droplets and helps nebulize and disperse the droplets into a spray as it is directed out through tip end 76.

Spray tip 36 is made slightly tapered to allow an extension to be slipped over it or to receive connector assemblies. The dimensions and structure of spray tip 36 can be configured to create spray droplets or mist droplets. Additionally, alternative spray tip nozzles and channel geometry could be used with spray head adapter 6 as desired for adaption to liquids of different viscosities.

Figure 8:
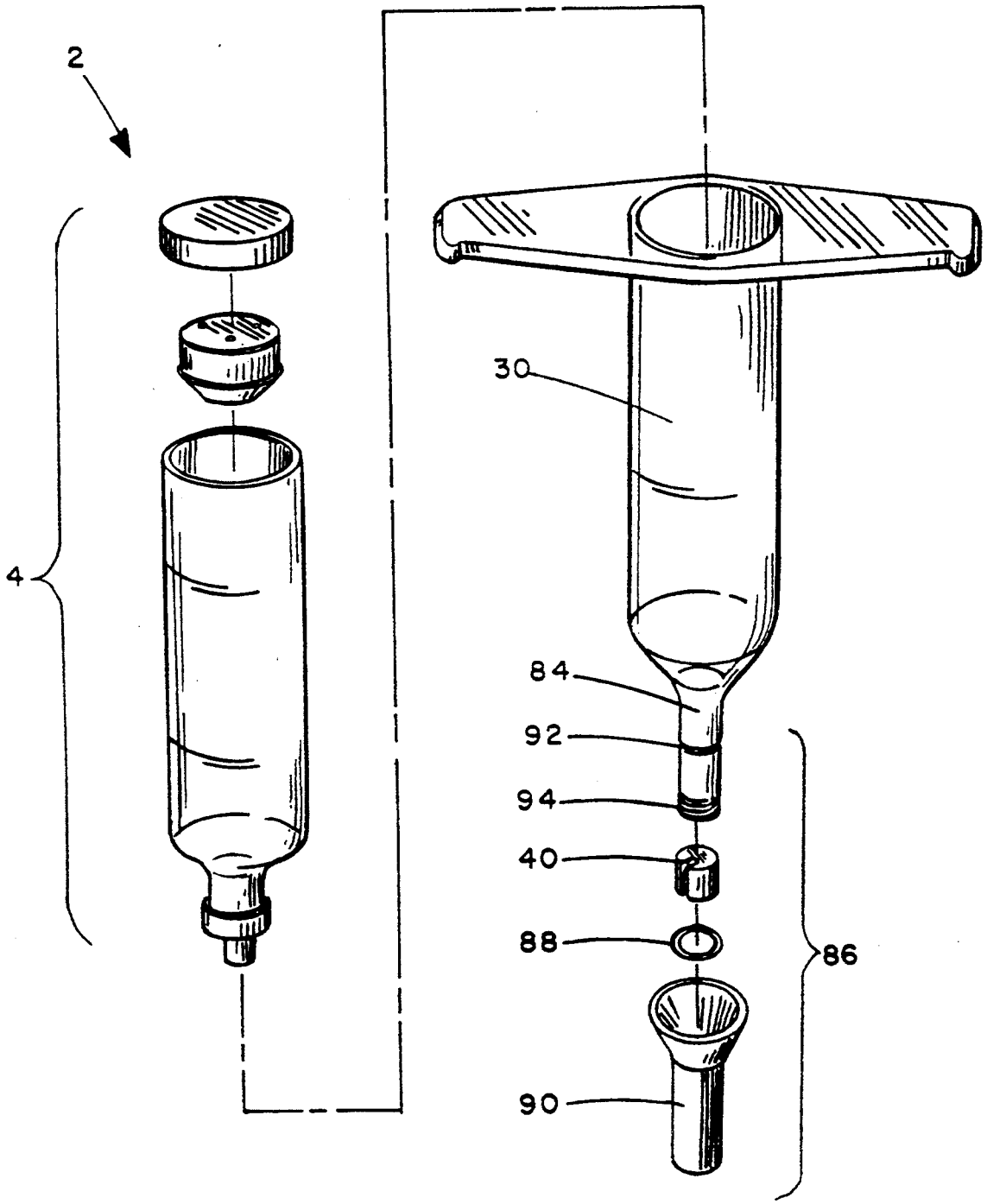
FIG. 8 is an alternative embodiment of the invention shown in exploded perspective view having the pump assembly fully assembled and an adjustable nozzle disposed on the spray tip of the spray head adapter.
Figure 9:
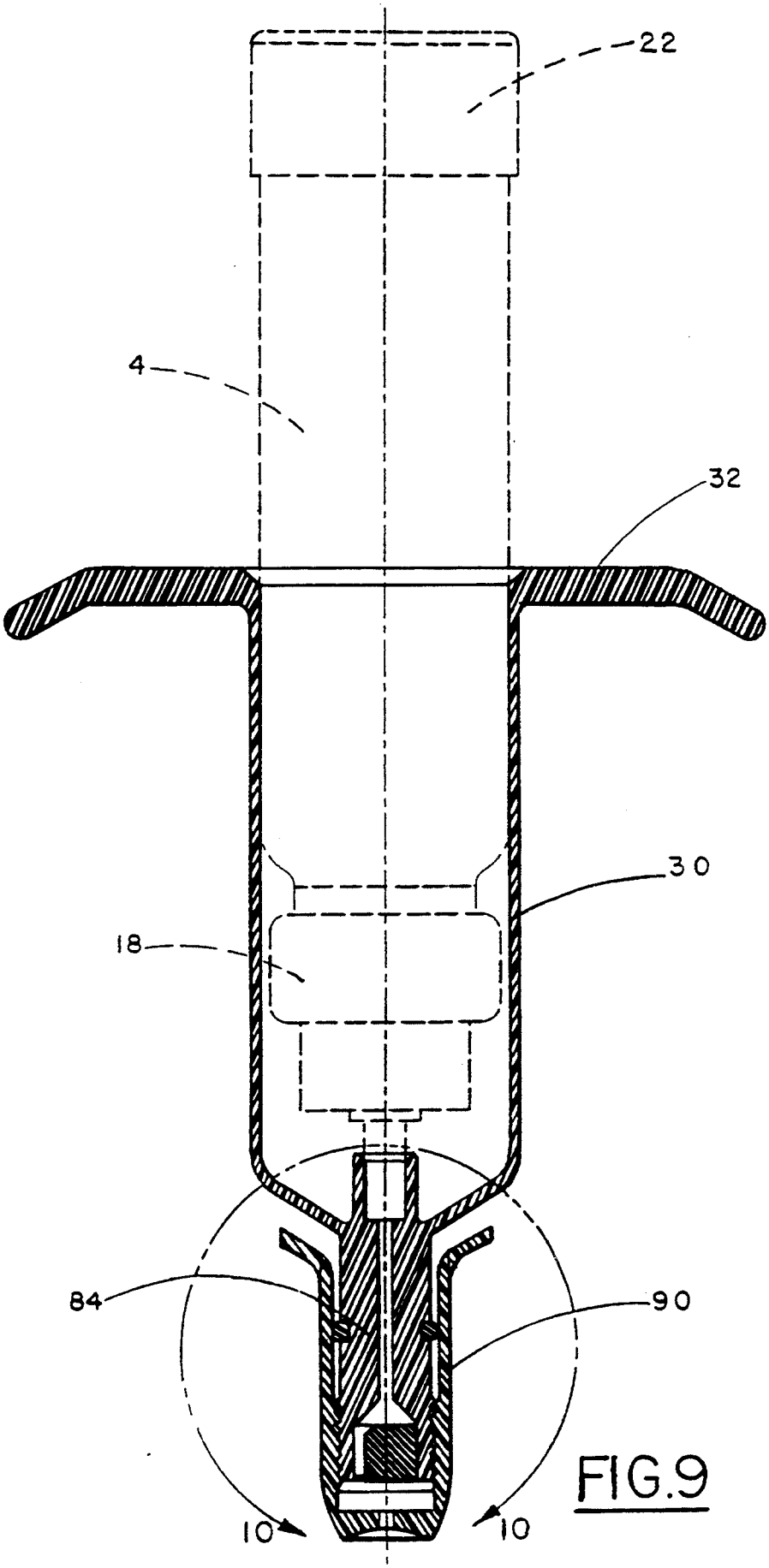
FIG. 9 is a cross-sectional view of the embodiment shown in FIG. 8, illustrating the components of the adjustable nozzle and showing the sprayer-sub-assembly in phantom lines.
Figure 10:
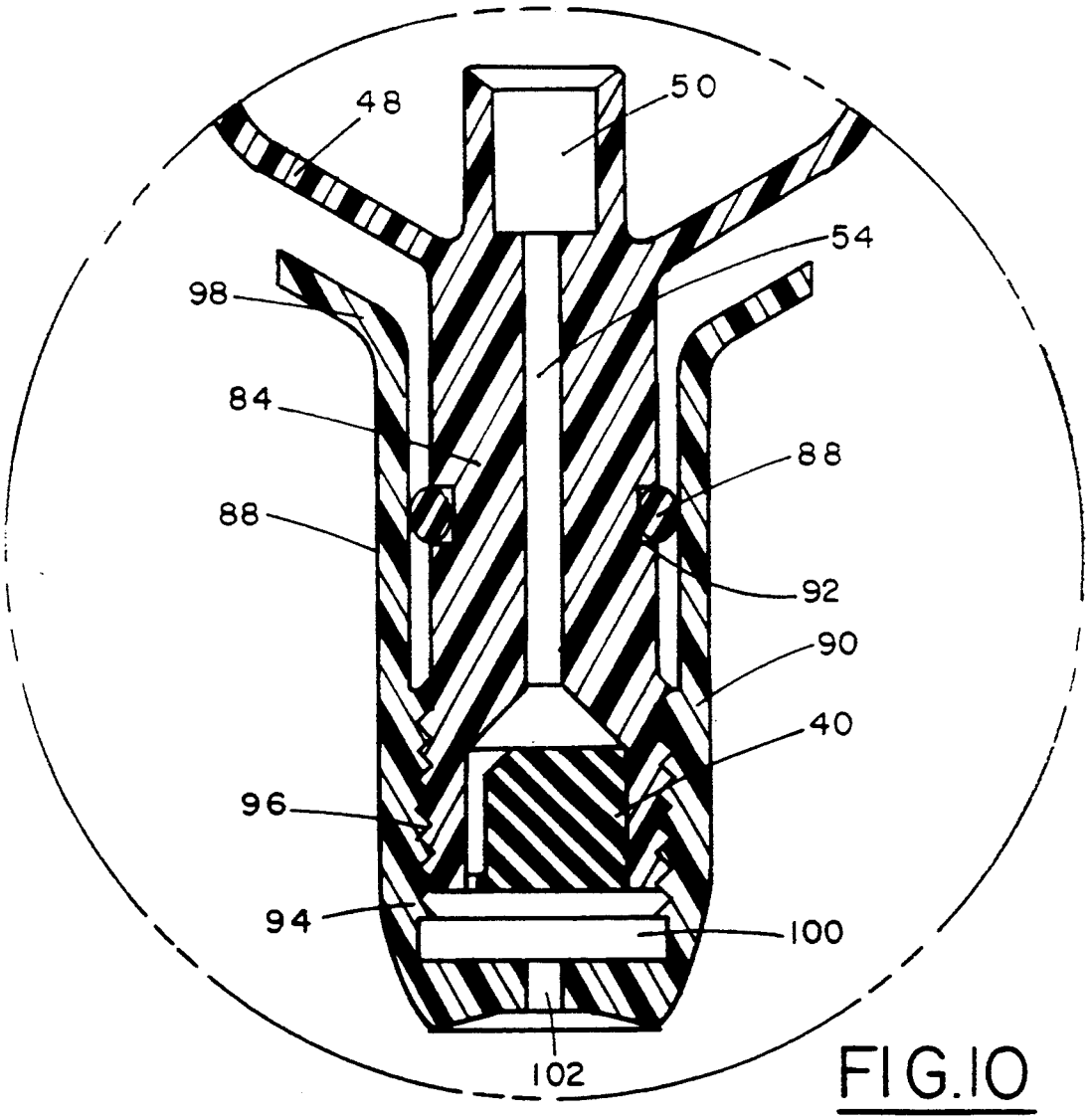
FIG. 10 is an expanded view of the adjustable nozzle illustrated in FIG. 9.

An alternative embodiment of the invention is shown in FIGS. 8–10. FIG. 8 illustrates, in exploded view, topical sprayer 2 which is identical in all respects to the embodiment previously described except that spray tip 84 is configured to include adjustable nozzle assembly 86.

Adjustable nozzle assembly 86 allows adjustment of the atomization of the liquid dispensed through spray tip 84 to droplets sized from spray (100–1,000 microns in diameter) to mist (10–100 microns in diameter). Adjustable nozzle assembly 86 includes swirl atomizer 40 previously described, sealing ring 88 and adjustable spray head 90. Spray tip 84 is modified from spray tip 36 of the previous embodiment to include seat 92 and threads 94.

Referring to FIG. 9, the alternative embodiment of the invention shown in FIG. 8 is illustrated assembled in cross section. Spray tip 84 is constructed having seat 92 for receiving sealing ring 88 and threads 94 disposed near the distal end. Adjustable spray head 90 includes corresponding threads 96 which mate with threads 94 of spray tip 84, and has fluted portion 98 which conforms with taper 48 on body 30.

In the assembled condition, spray head 90 is threaded onto spray tip 84 via threads 94 and 96 as shown in greater detail of FIG. 10. Sealing ring 88 provides a fluid tight seal between spray head 90 and spray tip 84 as well as providing additional support between the two members. Spray head 90 is rotatable relative to spray tip 84 about threads 94 and the amount of threaded engagement adjusts the volume of exit chamber 100 formed between atomizer 40 and spray aperture 102. As spray head 90 is threaded onto spray tip 84, the volume of chamber 100 decreases, and the resultant relative atomization of liquid exiting spray aperture 102 increases. That is, as the volume of chamber 100 decreases, the average diameter of droplets formed by atomizer 40 within chamber 100 also decreases. Adjustment of the amount of threaded engagement between spray head 90 and spray tip 84 therefore provides adjustment of the resultant atomization of exiting atomizing liquid between, for example, a spray and a mist.

The foregoing description of the preferred embodiments of the invention have been presented for purposes of illustration and description. It is not intended to be exhaustive or to limit the invention to the precise form disclosed, and obviously many modifications and variations are possible in light of the above teaching. For example, liquid container 10 can take a wide range of sizes and configurations including a compliant bag in a rigid housing or the like, and can be pressurized by aerosol, mechanical means, etc. When liquid container 10 is other than cylindrical, spray head adapter 6 is altered in shape to accommodate the contours of liquid container 10 as required without deviating from the scope of the invention. The embodiments chosen and described in this description were selected to best explain the principals of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A hand held fluid spray mechanism for topical application of contained fluid medications, said spray mechanism comprising:

a spray subassembly having:

a receiving chamber for receiving and holding said fluid medication;

a top for sealing said spray subassembly for maintaining said fluid medications within said receiving chamber;

a pump mounted to said top having an inlet communicated to said receiving chamber, an outlet protruding from said top, and operative upon compression of said outlet toward said top to pump said fluid medications from said inlet to said outlet under pressure;

means for providing a free floating piston slideably in liquid tight contact with the interior of said container and capturing the fluid between the piston and the top of said container;

a spray head adapter having:

a defined receiving concavity having an opening for detachably receiving and holding said spray subassembly;

a spray tip for atomizing fluid medications discharged under pressure from said outlet of said pump; and, an outlet mounting defining a receiving aperture for permitting said outlet of said pump of said spray subassembly to pump fluid medication through said top to discharge fluid medication under pressure;

a flow passage between said outlet mounting and said spray tip for permitting flow of said fluid medication under pressure from said spray subassembly to said spray tip for atomization of said contained fluid medications; and, at least one finger ledge mounted adjacent said defined receiving concavity for permitting said spray subassembly to be depressed into said receiving concavity at said outlet mounting whereby said pump causes discharge to said spray tip to atomize said fluid medication.

2. The hand held fluid spray mechanism of claim 1 and wherein said defined receiving concavity of said spray head adapter is fluid tight from said opening to said spray tip.

3. The hand held spray mechanism of claim 1 and including:

a swirl atomizer comprising:

a central ring channel;

a plurality of spoke passageways communicated to said spring channel centrally at commonly eccentric entrances and extending to the periphery of said swirl atomizer whereby fluid entering said ring channel is atomized; and, means communicating spray from said pump to said channels at the periphery of said swirl atomizer whereby fluid is forced under pressure to enter said ring channel and atomization occurs.

* * * * *